US005960904A

United States Patent [19]

Ullmann

[11] Patent Number: 5,960,904

[45] Date of Patent: Oct. 5, 1999

[54] WORK TABLE FOR USE ON A PEAKED ROOF

[76] Inventor: Robert A. Ullmann, 1363 Lime Kiln, Green Bay, Wis. 54311

[21] Appl. No.: 09/123,540

[22] Filed: Jul. 28, 1998

[51] Int. Cl.[6] ..... E04G 3/14

[52] U.S. Cl. ..... 182/45; 248/237

[58] Field of Search ..... 182/45; 248/237

[56] References Cited

U.S. PATENT DOCUMENTS

| | | |
|---|---|---|
| 1,365,996 | 1/1921 | Herwick . |
| 3,058,542 | 10/1962 | Rogalla . |
| 3,866,715 | 2/1975 | Foulk . |
| 4,450,935 | 5/1984 | Gustavus . |
| 4,754,713 | 7/1988 | Chatenay epouse Compagnone . |
| 4,856,745 | 8/1989 | Mabie . |
| 5,325,794 | 7/1994 | Hontani . |
| 5,588,377 | 12/1996 | Fahmian . |

FOREIGN PATENT DOCUMENTS

| | | |
|---|---|---|
| 2195886 | 4/1988 | United Kingdom . |

*Primary Examiner*—Alvin Chin-Shue
*Attorney, Agent, or Firm*—Richard C. Litman

[57] ABSTRACT

The invention is a work table for use on a peaked roof comprising a horizontal frame forming the support surface, and four leg members. The leg members pivotally attach to the horizontal frame, and the angle of the leg members can be adjusted to correspond to the pitch of a roof. The table sits directly on top of a roof, with the sides of the legs directly against the roof, thereby holding it in place. The invention does not require spikes or nails to hold it in place, preventing damage to the roof. Additionally, the invention can be placed on the peak of a roof without anyone on the roof, ensuring the safety of roofing personnel.

4 Claims, 3 Drawing Sheets

WORK TABLE FOR USE ON A PEAKED ROOF

BACKGROUND OF THE INVENTION

1. Field of the Invention

The present invention relates to roof top work tables. Specifically, the invention is a roof top work table designed to sit on top of a peaked roof. The table has adjustable legs to conform to the pitch of the roof. It provides a means of supporting roof shingles in a safe and effective manner, without damaging the roof.

2. Description of the Related Art

Other inventors have attempted to devise a way to support working materials on a roof. Many of these inventions are inadequate for this purpose because they can damage the roof on which their supports sit. More importantly, users of many rooftop tables must climb onto the roof to secure the table onto the roof, increasing the danger involved in their work. For example, U.S. Pat. No. 3,866,715, issued to Frank M. Foulk, describes an adjustable roofing platform comprising a frame having spikes on the bottom lying against the roof, and an adjustable L-shaped frame for holding the platform in a horizontal position. U.S. Pat. No. 4,856,745, issued to Dana Mabie, describes an adjustable roof scaffold support comprising a base plate having holes for nailing the scaffold to a roof, a telescoping support leg hingedly connected to the base, and adjustable arms forming the support surface of the scaffold. Both of these inventions use spikes or nails to fasten the invention to a roof, requiring the user to climb onto the roof to secure the base to the roof, and to put holes in the roof.

U.S. Pat. No. 4,450,935, issued to David C. Gustavus, describes a platform comprising a base suited to hooking onto the rungs of a roof ladder, and a platform capable of being elevated by a screw and thrust bearing arrangement, turned by a hand crank. The current invention has the advantage of not requiring the use of a roof ladder, unlike Mr. Gustavus' invention.

Several other tables have various means of adjusting the height of the table. These tables were designed for use on the ground, and are not suitable for use on a roof. For example, U.S. Pat. No. 4,754,713, issued to Catherine M. Chatenay Epouse Compagnone, describes a table having at each end one fixed leg and one adjustable length leg, connected at the end away from the table. The angle of the table's surface can be changed to correspond to the ground underneath. Additionally, U.S. Pat. No. 5,325,794, issued to Kenro Hontani, describes an adjustable height display table having a sliding member with a crank bar connecting the legs to the table, wheels at the ends of the legs, and a support bar running from the center of each leg to the ends of the table.

At least two tables use a scissors linkage to adjust the height of the table: U.S. Pat. No. 5,588,377, issued to Hal Fahmian, and U.K, Pat. App. No. 2,195,886. Both of these tables are intended to be used on the ground, and are therefore not suitable for use on a roof.

None of the above inventions and patents, taken either singularly or in combination, is seen to describe the instant invention as claimed. Thus a work table for use on a peaked roof solving the aforementioned problems is desired.

SUMMARY OF THE INVENTION

The invention is a work table intended to sit directly on the peak of a roof, supporting roofing shingles or possibly other materials. The table has a frame in a horizontal plane, forming the support surface, and four adjustable legs. Two legs are connected at each end of the table. Each pair of legs comprises a pair of inner members pivotally connected to the center of one end of the table, and a pair of telescoping members pivotally connected at one end near the corners of the table, and at the other end to the ends of the inner members. Adjusting the length of the telescoping members adjusts the angle formed by the inner members, allowing the sides of the inner members to lie flat against a roof.

The length and width of the table should be small enough to easily transport, but large enough so that it sits on a sufficient number of rafters to support its weight. Suggested dimensions are 4 ft. long (parallel to the roof peak), and 3 ft. wide (perpendicular to the roof peak). The 4 ft. length ensures that the table will sit on at least 3 rafters, which will adequately support the 1½ tons of shingles which will most likely be placed on the table. The 3 ft. width corresponds to the length of a bundle of shingles.

The invention can easily be placed on a roof without the need for anyone to be present on the roof during that operation, an important safety feature. Beginning with the invention sitting in a truck bed with the legs collapsed and the shingles resting on the horizontal frame, the invention is lifted off the truck with a forklift, and moved to a position wherein a person on the ground can adjust the legs to the pitch of the roof. The forklift then lifts the invention, placing it directly over the peak of the roof.

As an additional feature, the invention may be used on the ground. After adjusting the legs to the desired angle, leg extensions can be inserted into the ends of the inner legs, raising the table to a sufficient height for use on the ground.

Accordingly, it is a principal object of the invention to provide a rooftop work table which can safely support roofing shingles and other work materials on a roof without the necessity of putting holes in the roof.

It is another object of the invention to provide a rooftop work table which ensures that the weight of its load will be properly distributed across the roof's rafters.

It is a further object of the invention to provide a rooftop work table which can be placed on the roof without anyone on the roof, ensuring the safety of the roofing personnel.

Still another object of the invention is to provide a rooftop table which can also be used on the ground.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
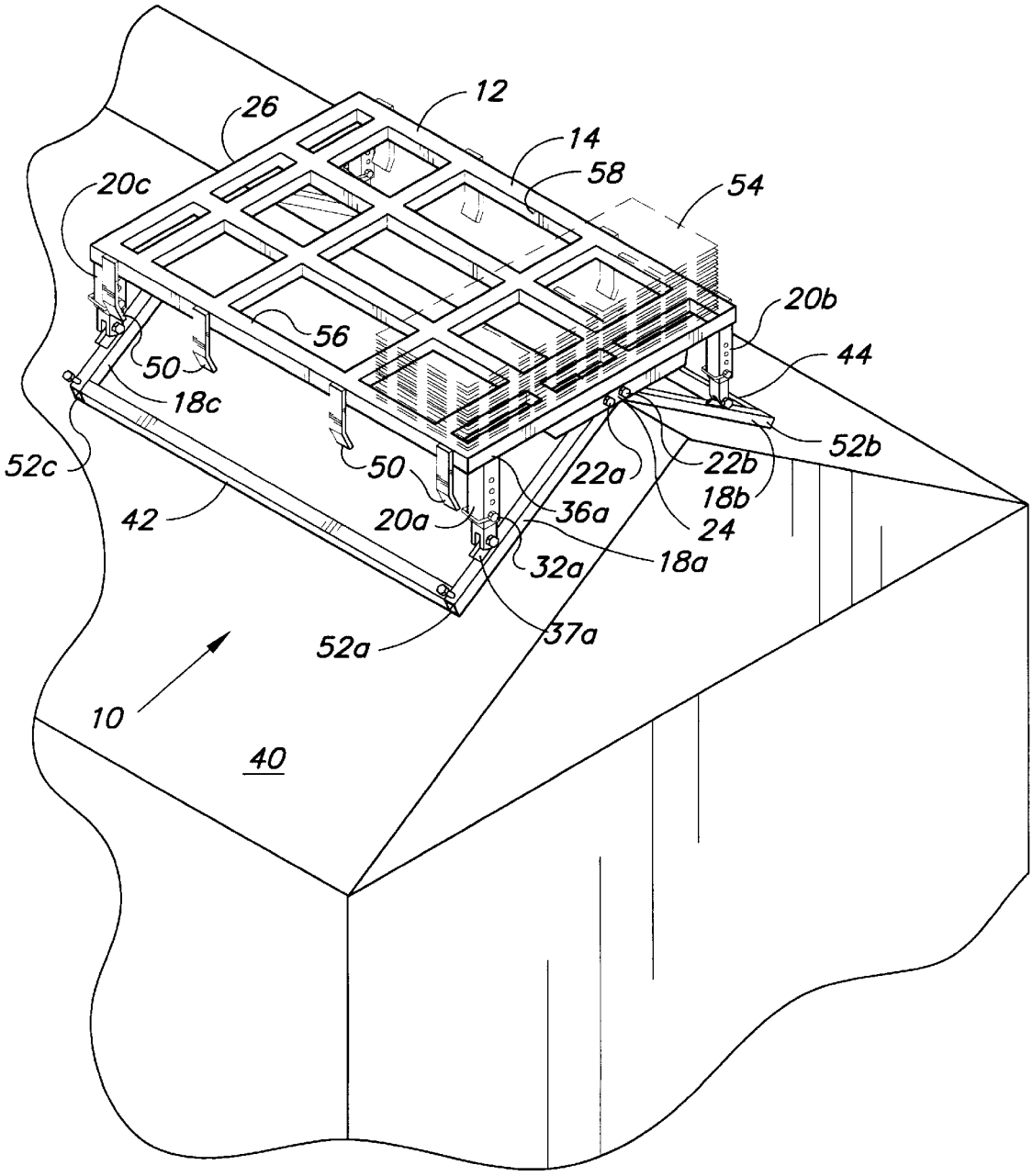
FIG. 1 is an environmental perspective view of a work table for use on a peaked roof according to the present invention.

The present invention is a work table designed to sit directly on the peak of a peaked roof. Referring to FIG. 1, the table 10 conveniently holds a desired load (bundles of shingles 54) while sitting on a roof supported by an appropriate number of rafters for the weight on the table 10. The preferred embodiment of the work table 10 is generally rectangular, comprising a horizontal frame 12 forming the support surface 14, including two ends 24,26 and two sides 56,58. The frame 12 is supported by an adjustable leg assembly, including four legs 16*a*,16*b*,16*c*,16*d* depending downward, a pair of legs positioned to each side of the roof peak. Each leg of the pair pivots relative to the other to form an angle of a range of angles from 0 to 180 degrees, thereby forming a selected angle between the legs which corresponds to the angle defined by the roof peak.

Figure 2:
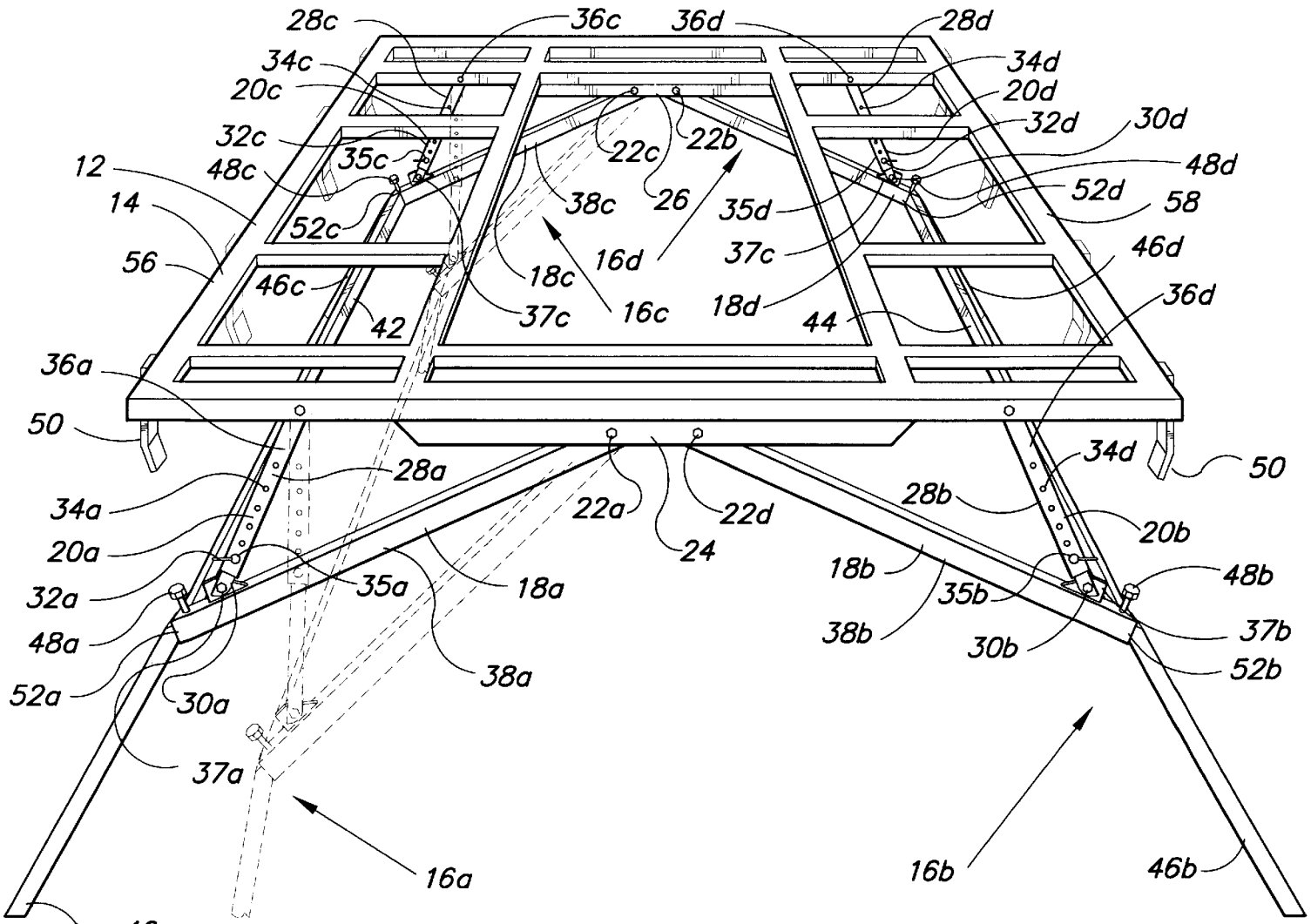
FIG. 2 is an end perspective view of a work table for peaked roofs showing details of the leg adjustment means.

Referring to FIGS. 1 and 2, the specific features permitting the above application and configuration are shown. Each leg 16*a*,16*b*,16*c*,16*d* comprises an inner leg 18*a*,18*b*, 18*c*,18*d*, and an outer telescoping member (or adjustable support strut) 20*a*,20*b*,20*c*,20*d*. Inner legs 18*a*,18*b* are pivotally attached at their top ends 22*a*,22*b* to horizontal frame 12 at the center of frame end 24. Likewise, inner legs 18*c*,18*d* are pivotally attached at their ends 22*c*,22*d* to horizontal frame 12 at frame end 26. This permits radial positioning of each leg independently across an imaginary arc, each point of the arc corresponding to one of a range of varying roof pitches possible for a peaked roof having a predetermined pitch for each of at least two roof surfaces defining the peak.

To fix each leg at the appropriate radial position, an adjustable support strut assembly is provided. Adjusting the length of each support strut (telescoping members 20*a*,20*b*, 20*c*,20*d*) to the proper length therefore adjusts inner legs 18*a*,18*b*,18*c*,18*d* so that the sides 38*a*,38*b*,38*c*,38*d* of legs 18*a*,18*b*,18*c*,18*d* lie flat against each roof surface 40. The telescoping members 20*a*,20*b*,20*c*,20*d* comprise outer sleeves 28*a*,28*b*,28*c*,28*d*, inner rods 30*a*,30*b*,30*c*,30*d*, and pins 32*a*,32*b*,32*c*,32*d*, respectively. Inner rods 30*a*,30*b*,30*c*, 30*d* slidably fit within the corresponding outer sleeves 28*a*,28*b*,28*c*,28*d*. Pins 32*a*,32*b*,32*c*,32*d* fit into holes 34*a*, 34*b*,34*c*,34*d* on the outer sleeves 20*a*,20*b*,20*c*,20*d*, and corresponding holes 35*a*,35*b*,35*c*,35*d* on the inner rods 30*a*,30*b*,30*c*,30*d*, holding the corresponding inner rods 30*a*, 30*b*,30*c*,30*d* and outer sleeves 28*a*,28*b*,28*c*,28*d* in place to maintain the proper length. Telescoping members 20*a*,20*b*, 20*c*,20*d* are pivotally attached at ends 36*a*,36*b*,36*c*,36*d* near a corner of horizontal frame 12, and pivotally attached at ends 37*a*,37*b*,37*c*,37*d* to the inner legs 18*a*,18*b*,18*c*,18*d*. This arrangement thereby permits angular adjustment of each strut to maintain a perpendicular relationship with horizontal frame 12, while the legs are angularly adjusted to lie flat on the roof surface.

To add stability to the leg assembly, the preferred embodiment includes support beams 42,44, respectively connecting a pair of inner legs (18*a* to 18*c*, and, 18*b* to 18*d*). Each pair of legs is therefore also bound to one another, and, is simultaneously adjusted to the same angular relation as the other of the pair. Thus, each beam 42,44 of its respective pair also lies flat upon the roof surface 40, providing further support, stability and safety to the overall structure by distributing the weight of the load over a greater area of the underlying roof structure.

Figure 3:
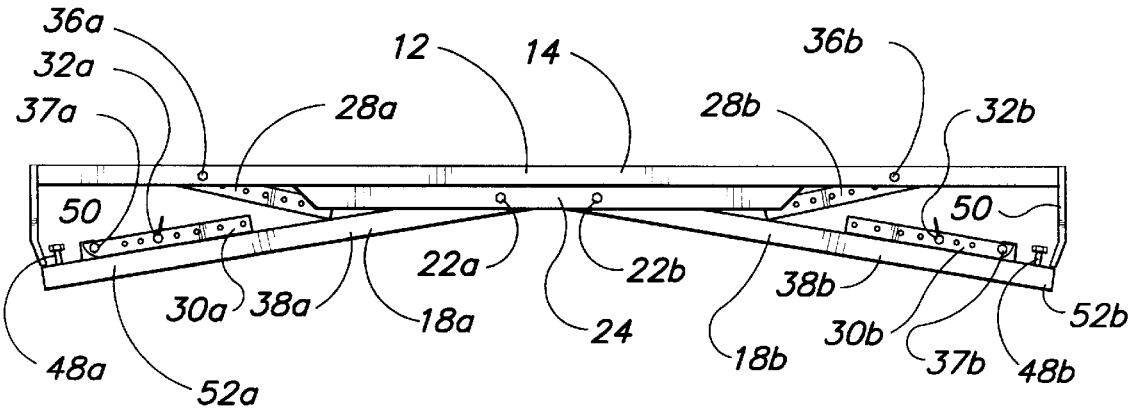
FIG. 3 is an end view of a work table for peaked roofs in the collapsed position.

In use, the table 10 may be obtained first in a storage state, wherein the legs 16*a*,16*b*,16*c*,16*d* are collapsed, as shown in FIG. 3. The legs are fully collapsible after inner rods 30*a*,30*b*,30*c*,30*d* are removed from outer sleeves 28*a*,28*b*, 28*c*,28*d*. Flanges 50 are attached to sides 56,58 of horizontal support 12, extending downward for support of the horizontal support 12 off of ground level when in the collapsed position. Flanges 50 are positioned and spaced apart so that they support the weight of horizontal support 12 and any load thereon and pass the load forces directly onto support beams 42,44 of the leg assembly. The support beams 42,44 thus act as load bearing skids for distribution of the weight over a larger area. Thus, a heavy load, such as roof shingles 54, can be loaded onto the table 10 while in a collapsed state and used in the manner of a pallet, whereupon a forklift lifts the invention to a suitable position so that a person on the ground can attach ends 36*a*,36*b*,36*c*,36*d* of telescoping members 20*a*,20*b*,20*c*,20*d* to horizontal support 12. The angle of the legs 16*a*,16*b*,16*c*,16*d* are then adjusted to correspond to the pitch of the roof 40. Lastly, the forklift raises the invention, and lowers it directly onto the peak of the roof 40.

Referring to FIG. 1, the dimensions of the table should be such that the table will conveniently hold the desired load without being excessively bulky, and must also ensure that the table, when sitting on a roof, is supported by an appropriate number of rafters for the weight on the table. Suggested dimensions are 4 ft. long (parallel to the roof peak, between ends 24 and 26) and 3 ft. wide (perpendicular to the roof peak, between sides 56,58). The 4 ft. length ensures that the table will be supported by at least 3 rafters, which can adequately support a 1½ ton load. The 3 ft. width is equal to the length of a bundle of roof shingles 54.

Figure 4:
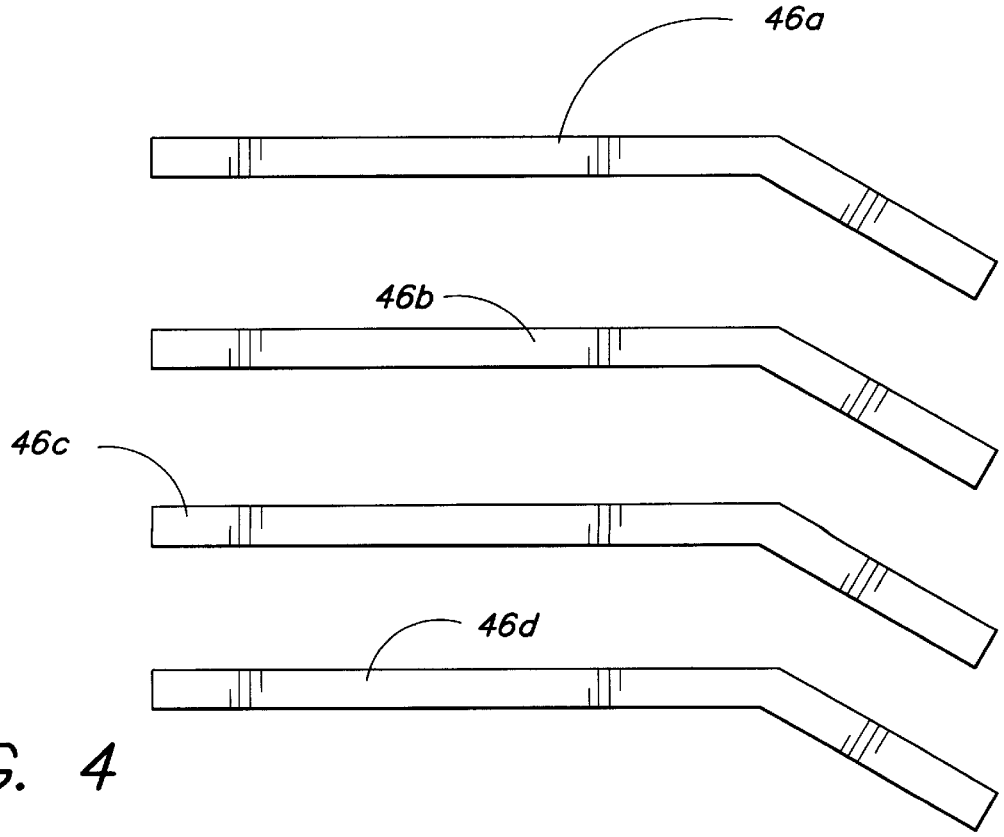
FIG. 4 is a plan view of the four leg extensions.

Referring to FIGS. 2 and 4, the invention also includes four leg extensions, 46*a*,46*b*,46*c*,46*d*, for conversion of the work table 10 for use as a simple work surface or table at waist height. These extensions are configured to be inserted into inner legs 18*a*,18*b*,18*c*,18*d*, and are held in place by threaded bolts 48*a*,48*b*,48*c*,48*d*, which act as set screws by binding extensions 46*a*,46*b*,46*c*,46*d* against the inside of inner legs 18*a*,18*b*,18*c*,18*d*.

It is to be understood that the present invention is not limited to the embodiment described above, but encompasses any and all embodiments within the scope of the following claims.

I claim:

1. A work table for use on a peaked roof, the peaked roof defining a pitch, the work table comprising:

a horizontal support structure having a top surface, a bottom surface, a first end having a corresponding first pair of corners and a center therebetween, a second end having a corresponding second pair of corners a center therebetween, a length defined between said first end and said second end, a first side, a second side, and a width defined between said first and second sides;

four elongated inner leg members having a top end and a bottom end, two of said inner leg members pivotally connected at said top end proximate said center of said support structure's first end, and two of said inner leg members pivotally connected at said top end proximate said center of said second end, said inner leg members pivoting between a collapsed position and a position corresponding to the pitch of the roof;

a first and second support beam, each of said support beams having a pair of ends, said first support beam connecting at said ends to said inner legs corresponding to said support structure's first side, and being in the same plane as said inner legs corresponding to said support structure's first side, said second support beam connecting at said ends to said inner legs corresponding to said support structure's second side, and being in the same plane as said inner legs corresponding to said support structure's second side, for lying flat against the roof when said inner legs are in said position corresponding to the pitch of the roof; and four telescoping outer leg members, each outer leg comprising an outer sleeve, an inner rod, and a pin, said outer sleeve having an outer end and a connector end, said connector end having a plurality of holes substantially perpendicular to said sleeve, said inner rod having a connector end and an outer end, said inner rod's connector end having at least one hole substantially perpendicular to said rod, said rod's connector end fitting within said sleeve's connector end, said pin passing through said rod's hole and one of said sleeve's holes, each of said telescoping legs further having a top end and a bottom end, said telescoping leg's top ends each pivotally connected in close proximity to one of said support surface's corners, and each of said telescoping leg's bottom ends pivotally connected to said inner legs, wherein said inner legs at bottom sections thereof are hollow, and have holes substantially perpendicular to said inner legs; and further comprising; four leg extensions, and each extension having a hole substantially perpendicular to said extension, corresponding to said hole in said inner leg; and four pins, each corresponding to one of said extension, fitting within said holes in said extensions and said legs.

2. The work table according to claim 1, wherein said length is approximately 4 ft., and said width is approximately 3 ft.

3. The work table according to claim 1, wherein said horizontal support structure comprises a metal frame.

4. The work table according to claim 1, further comprising a plurality of flanges extending downward from said sides of said horizontal support structure.

* * * * *